US009422127B2

(12) United States Patent
Terrero et al.

(10) Patent No.: US 9,422,127 B2
(45) Date of Patent: Aug. 23, 2016

(54) FINISHER REGISTRATION SYSTEM USING OMNIDIRECTIONAL SCUFFER WHEELS

(71) Applicant: Xerox Corporation, Norwalk, CT (US)

(72) Inventors: Carlos Manuel Terrero, Ontario, NY (US); Brian J. Dunham, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/246,615

(22) Filed: Apr. 7, 2014

(65) Prior Publication Data

US 2015/0284203 A1 Oct. 8, 2015

(51) Int. Cl.

| | |
|---|---|
| ***B65H 31/36*** | (2006.01) |
| ***B65H 5/06*** | (2006.01) |
| ***B65H 9/10*** | (2006.01) |
| ***B65H 31/38*** | (2006.01) |

(52) U.S. Cl.

CPC ..... *B65H 5/068* (2013.01); *B65H 9/101* (2013.01); *B65H 9/106* (2013.01); *B65H 31/36* (2013.01); *B65H 31/38* (2013.01); *B65H 2404/12* (2013.01); *B65H 2404/1521* (2013.01); *B65H 2404/54* (2013.01); *B65H 2406/323* (2013.01); *B65H 2801/27* (2013.01)

(58) Field of Classification Search

CPC ..... B65H 31/34; B65H 31/36; B65H 9/106; B65H 9/103; B65H 9/166; B65H 2301/33; B65H 2301/362; B65H 2301/3621; B65H 2301/36212; B65H 2301/363; B65H 2301/4222; B65H 2408/114; B65H 2408/1144; B65H 2404/10; B65H 2404/11; B65H 2404/111; B65H 2404/1114; B65H 2404/1115; B65H 2404/1116; B65H 2404/113; B65H 2404/114; B65H 2404/115; B65H 2404/117; B65H 2404/12; B65H 2404/121; B65H 2404/122; B65H 2404/123; B65H 2404/1231; B65H 2404/132; B65H 2404/1321; B65H 2404/13212; B65H 2404/1412

See application file for complete search history.

(56) References Cited

U.S. PATENT DOCUMENTS

| | | | | |
|---|---|---|---|---|
| 3,964,588 A * | 6/1976 | Kornylak | ..... | B65G 13/10 193/35 MD |
| 4,981,203 A * | 1/1991 | Kornylak | ..... | B65G 13/10 193/35 MD |
| 5,338,022 A * | 8/1994 | Funk | ..... | B65H 31/34 271/184 |

(Continued)

FOREIGN PATENT DOCUMENTS

| | | | | |
|---|---|---|---|---|
| DE | 4326026 A1 * | 2/1995 | ..... | B65H 5/068 |
| JP | WO 2013014697 A1 * | 1/2013 | ..... | B65H 3/0638 |

*Primary Examiner* — Ernesto Suarez

(74) *Attorney, Agent, or Firm* — BudzynFortunato IP Law, LLC

(57) ABSTRACT

A sheet registration system is for use in connection with a finisher for a digital printing system. A scuffer carriage has omnidirectional scuffer wheels with a plurality of overlapping rollers to provide uninterrupted traction to move media sheets against a registration wall for process direction registration. A pair of opposed tamper plates will move toward one another pushing the media sheets together in the cross process direction. The freely rotating scuffer rollers will allow free movement of the media sheets in the cross process direction. Thus, cross process registration is achieved simultaneously with process direction registration, and registration time is minimized. Process direction registration is maintained by not lifting the scuffer from the media sheets during cross process registration.

10 Claims, 10 Drawing Sheets

(56) References Cited

U.S. PATENT DOCUMENTS 5,404,984 A * 4/1995 Hagman ..... B65G 13/10 193/35 MD
6,164,642 A * 12/2000 Onipchenko ..... B65H 9/101 271/171
6,554,276 B2 * 4/2003 Jackson ..... B65H 15/00 271/186
6,705,603 B1 * 3/2004 Kirino ..... B42C 1/12 270/12
7,566,051 B2 * 7/2009 Kodama ..... B65H 31/26 270/58.01
7,891,652 B2 * 2/2011 Mandel ..... B41J 13/0009 270/58.02
2008/0179826 A1 * 7/2008 Gregoire ..... B65G 13/10 271/264
2010/0196073 A1 * 8/2010 Taki ..... B65H 29/14 399/405

* cited by examiner

FINISHER REGISTRATION SYSTEM USING OMNIDIRECTIONAL SCUFFER WHEELS

CROSS-REFERENCE TO RELATED APPLICATIONS

Not applicable

INCORPORATION BY REFERENCE

Not applicable

TECHNICAL FIELD

This invention relates to registration of media sheets in digital printing machines, and, more particularly, to an apparatus, system, and method utilizing a scuffer mechanism for leading edge and lateral registration of media sheets in high speed finishers during stacking.

BACKGROUND

Digital printing machines can take on a variety of configurations. One common process is that of electrostatographic printing, which is carried out by exposing a light image of an original document to a uniformly charged photoreceptive member to discharge selected areas. A charged developing material is deposited to develop a visible image. The developing material is transferred to a medium sheet (paper) and heat fixed.

Another common process is that of direct to paper ink jet printing systems. In ink jet printing, tiny droplets of ink are sprayed onto the paper in a controlled manner to form the image. Other processes are well known to those skilled in the art.

The primary output product for a typical digital printing system is a printed copy substrate such as a sheet of paper bearing printed information in a specified format. Quite often, customer requirements necessitate that this output product be configured in various specialized arrangements ranging from stacks of collated loose printed sheets, to brief reports stapled together, to tabulated and bound booklets. The sheets of media, usually paper, are compiled, stapled, and ejected at the last stage of the job, in a region called a finisher.

Various external output devices have been designed for connection to a digital printing machine. The paper will exit the printing system and be passed to an external finishing device, wherein a critical parameter in such delivery is the capability to operate at process speed so as to not inhibit the function of the printing machine.

Finishing procedures, such as sorting, collating, stapling and ejecting, require the movement of mechanical components. In state of the art digital printing machines, it is common to have a quantity of sets in a job stream which require various sorts of finishing activities. In order to accommodate multiple sets, each set in the stream is typically held or delayed until the finishing activity of the preceding set has been completed. Moreover, it is often necessary to slow the output speed of the printing machine so as not to exceed the rate at which the external device, or finisher, can receive and process sets of output documents for producing the final output product. These finishing delay times detract from the overall productivity of the printing system.

Sheet registration must be carried out before stapling and ejecting sets are accomplished. Certain high speed production finishers utilize a scuffer mechanism during stacking to register the leading edge of the sheets by driving them into a vertical plate. In addition, the sheets are registered laterally by side tampers. The scuffing (process direction registration) and tamping (cross process registration) actions occur sequentially. The scuffer must lift prior to tamping to allow free lateral movement of the sheet. The scuffer then lowers to receive the next incoming sheet. An example of this registration system is found in Schwenk, U.S. Pat. No. 6,856,785, filed on Dec. 22, 2003. One problem with this method is that it slows productivity, because the in-line registration and the lateral registration are performed consecutively. Another problem with this method is that during the tamping process, the process direction registration may deteriorate since the sheets are no longer held by the scuffer in the process direction.

Mandel, U.S. Pat. No. 5,120,047, filed on Feb. 7, 1991, shows a scuffer wheel mechanism disposed at an angle to the process direction. The scuffer drives the paper against a first wall in the process direction, and against a second wall in the cross process direction. A problem with this type of registration is that a corner of the paper climbs one or both walls.

With higher speed finishing devices, this type of compiling does not keep up with the high production rate. An example of such a high speed finishing device is a newly introduced production finisher which operates at 157 ppm production rate. As the system speeds increase, a means to reduce finishing time without compromising stack registration is needed.

Accordingly, there is a need to provide a sheet registration and stacking system able to stack from one sheet up to a large number of sheets in sets with very close stack registration dimensions, both in the process direction and in the cross process direction.

There is a further need to provide a sheet registration and stacking system of the type described and that is able to stack and register sheets in the process direction and in the cross process direction simultaneously, so as to improve set registration and reduce the sheet compiling time, allowing sheets to be received at a faster rate without compromising in-set registration.

There is a yet further need to provide a sheet registration and stacking system of the type described and that is able to stack and register sheets rapidly, in the short time available between rapidly sequentially fed sheets, as in a high speed printer, so as not to slow down the sheet production rate of the printer.

There is a still further need to provide a sheet registration and stacking system of the type described and that is able to stack and register sheets with high reliability, absence of document edge damage or image smearing or operator danger. The system should accommodate a wide range of paper sheet sizes and weights and/or stiffness, and with an apparatus that is mechanically simple and robust, thereby minimizing cost and avoiding the problems associated with the prior art.

SUMMARY

In one aspect, a sheet registration system has omnidirectional scuffer wheels, and is for use in connection with a finisher for a digital printing system. At least one media sheet moves in a process direction through the printing system.

The registration system includes a first scuffer having a first omnidirectional wheel and a second omnidirectional wheel. Each one of the first and second wheel has a wheel axis of rotation. The first and second wheels are mounted collinearly for corotation on the wheel axis generally perpendicular to the process direction.

Each one of the first and second wheels has a plurality of spokes. Adjacent spokes have facing trunnions directed toward each other in a pair on a common trunnion axis.

Each one of the first and second wheel has a plurality of rollers. Each roller has a roller length extending between opposite roller ends. Each roller has an arcuate curve of a predetermined radius between the roller ends. Each roller is mounted for rotation on a pair of the facing trunnions. Adjacent rollers on each wheel are spaced apart linearly end-to-end by a distance less than the roller length. Each roller on the first wheel partly overlaps each adjacent roller on the second wheel.

A scuffer carriage is mounted on the finisher over the media sheet. The carriage has an axle mounted generally perpendicular to the process direction. The first scuffer is mounted on the axle for rotation. The carriage is adapted for raising the scuffer upward into a raised position out of contact with the media sheet. The carriage is adapted also for lowering the scuffer downward into a lowered position into contact with the media sheet. Driving means is provided for rotationally driving the scuffer.

A registration wall is disposed generally vertically and facing generally upstream to the process direction, so as to align a leading edge of the media sheet. Thus, in the lowered position with the scuffer rotating, the overlapping scuffer rollers will provide uninterrupted traction against the media sheet in the process direction. In addition, the scuffer will move the media sheet against the registration wall for process direction registration.

A pair of opposed tamper plates is disposed generally vertically and facing one another in the cross process direction on either side of the media sheet. The tamper plates are mounted for translation toward one another. During registration, the tamper plates will move toward one another pushing the media sheet in the cross process direction. The freely rotating scuffer rollers will allow free movement of the media sheet in the cross process direction. In this manner, cross process registration is achieved simultaneously with process direction registration.

In another aspect, a sheet registration system has omnidirectional scuffer wheels, and is for use in connection with a finisher for a digital printing system. At least one media sheet moves in a process direction through the printing system.

The registration system includes a first scuffer having a first omnidirectional wheel and a second omnidirectional wheel. Each one of the first and second wheel has a wheel axis of rotation. The first and second wheels are mounted collinearly for corotation on the wheel axis generally perpendicular to the process direction.

Each one of the first and second wheels has a hub centered on the wheel axis. Each wheel has a plurality of spokes, each spoke extending radially outward from a proximal end at the hub to a distal end. Each spoke distal end has a pair of opposed trunnions lying in a plane perpendicular to the wheel axis. Adjacent spokes have facing trunnions directed toward each other in a pair on a common trunnion axis.

Each one of the first and second wheels has a plurality of rollers. Each roller has a roller axis and a roller length extending along the roller axis between opposite roller ends. Each roller has a diameter on the roller axis being greatest intermediate the roller ends. The diameter decreases toward each of the roller ends in an arcuate curve of a predetermined radius between the roller ends. Each roller is mounted for rotation on a pair of the facing trunnions. Adjacent rollers on each wheel are spaced apart linearly end-to-end by a distance less than the roller length. Adjacent rollers on each wheel are spaced apart angularly center-to-center by a predetermined angular displacement. The first wheel has an angular phase relationship with the second wheel of one half the roller predetermined angular displacement. Each roller on the first wheel partly overlaps angularly each adjacent roller on the second wheel.

A scuffer carriage is mounted on the finisher over the media sheet. The carriage has an axle mounted on an axle axis generally perpendicular to the process direction. The first scuffer is mounted on the axle for rotation. The carriage is adapted for raising the scuffer upward into a raised position out of contact with the media sheet. The carriage is likewise adapted for lowering the scuffer downward into a lowered position into contact with the media sheet.

Driving means is provided for rotationally driving the scuffer. Thus, in the lowered position with the scuffer rotating, the overlapping scuffer rollers will provide uninterrupted traction against the media sheet in the process direction. A scuffer actuator is provided for selectively lowering and raising the scuffer.

A registration wall is disposed generally vertically and facing generally upstream to the process direction, so as to align a leading edge of the media sheet. Thus, in the lowered position with the scuffer rotating, the scuffer will move the media sheet against the registration wall for process direction registration.

A pair of opposed tamper plates is disposed generally vertically and facing generally perpendicularly to the cross process direction. The tamper plates are spaced apart on either side of the media sheet. The tamper plates are mounted for translation toward one another. Hence, during registration, with the scuffer in the lowered position and with the scuffer rotating, the tamper plates will move toward one another pushing the media sheet in the cross process direction. The freely rotating scuffer rollers will allow free movement of the media sheet in the cross process direction. In this manner, cross process registration occurs simultaneously with process direction registration. A tamper actuator is provided for selectively moving the tamper plates toward one another and away from one another.

In yet another aspect, a sheet registration method is for use in connection with a finisher for a digital printing system and at least one media sheet moving in a process direction. The method includes contacting the media sheet with rollers of a first scuffer, and rotating the first scuffer. The first scuffer rollers are allowed free rotation in a cross-process direction, thereby allowing free movement of the media sheet in the cross process direction.

The first scuffer rollers are prevented from rotating in the process direction. This provides uninterrupted traction against the media sheet in the process direction. The media sheet is moved against a registration wall with the first scuffer for process direction registration.

A pair of tamper plates is moved toward one another. This pushes the media sheet in the cross process direction for cross process registration. Registering the media sheet in the cross process direction is achieved simultaneously with registering the media sheet in the process direction. This will minimize registration time. Roller contact with the media sheet is maintained during cross process registration. This will maintain process direction registration during cross process registration.

In still another aspect, a sheet registration method is for use in connection with a finisher for a digital printing system and at least one media sheet moving in a process direction. The method includes mounting a first omnidirectional wheel and a second omnidirectional wheel collinearly on a first scuffer. The wheels have a wheel axis generally perpendicular to the process direction.

A plurality of rollers is mounted in equal spaced relation around a perimeter of each wheel. Each roller on the first wheel angularly overlaps with each adjacent roller on the second wheel. This allows free rotation of the rollers in a cross-process direction. The free rotation of the rollers in turn allows free movement of the media sheet in the cross process direction. The rollers are prevented from rotation in the process direction, providing uninterrupted traction against the media sheet in the process direction.

The scuffer is lowered downward into a lowered position placing the rollers into contact with the media sheet. A registration wall is disposed generally vertically and facing generally upstream to the process direction. The wheels rotate, thereby moving the media sheet against the registration wall for process direction registration.

A pair of opposed tamper plates is disposed generally vertically and facing one another in the cross process direction. The tamper plates are spaced apart on either side of the media sheet. The tamper plates move toward one another pushing the media sheet in the cross process direction for cross process registration.

The media sheet is registered in the cross process direction simultaneously with registering the media sheet in the process direction. Hence, the required registration time is minimized. The rollers maintain contact with the media sheet during cross process registration. In this manner, process direction registration is maintained during cross process registration.

These and other aspects, objectives, features, and advantages of the disclosed technologies will become apparent from the following detailed description of illustrative embodiments thereof, which is to be read in connection with the accompanying drawings.

DETAILED DESCRIPTION

Describing now in further detail these exemplary embodiments with reference to the Figures as described above, the sheet finisher registration system with omnidirectional scuffer wheels is typically used in a select location or locations of the paper path or paths of various conventional media handling assemblies. Thus, only a portion of an exemplary media handling assembly path is illustrated herein. It should be noted that the drawings herein are not to scale.

As used herein, a "printer," "printing assembly" or "printing system" refers to one or more devices used to generate "printouts" or a print outputting function, which refers to the reproduction of information on "substrate media" or "media substrate" or "media sheet" for any purpose. A "printer," "printing assembly" or "printing system" as used herein encompasses any apparatus, such as a digital copier, bookmaking machine, facsimile machine, multi-function machine, etc. which performs a print outputting function.

A printer, printing assembly or printing system can use an "electrostatographic process" to generate printouts, which refers to forming and using electrostatic charged patterns to record and reproduce information, a "xerographic process", which refers to the use of a resinous powder on an electrically charged plate to record and reproduce information, or other suitable processes for generating printouts, such as an ink jet process, a liquid ink process, a solid ink process, and the like. Also, such a printing system can print and/or handle either monochrome or color image data.

As used herein, "media substrate" or "media sheet" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any media substrate in the form of a sheet amounts to a reasonable equivalent thereto. Also, the "leading edge" or "lead edge" (LE) of a media substrate refers to an edge of the sheet that is furthest downstream in the process direction.

As used herein, a "media handling assembly" refers to one or more devices used for handling and/or transporting media substrate, including feeding, printing, finishing, registration and transport systems.

As used herein, the terms "process" and "process direction" refer to a procedure of moving, transporting and/or handling a substrate media sheet. The process direction is a flow path the sheet moves in during the process.

Figure 1:
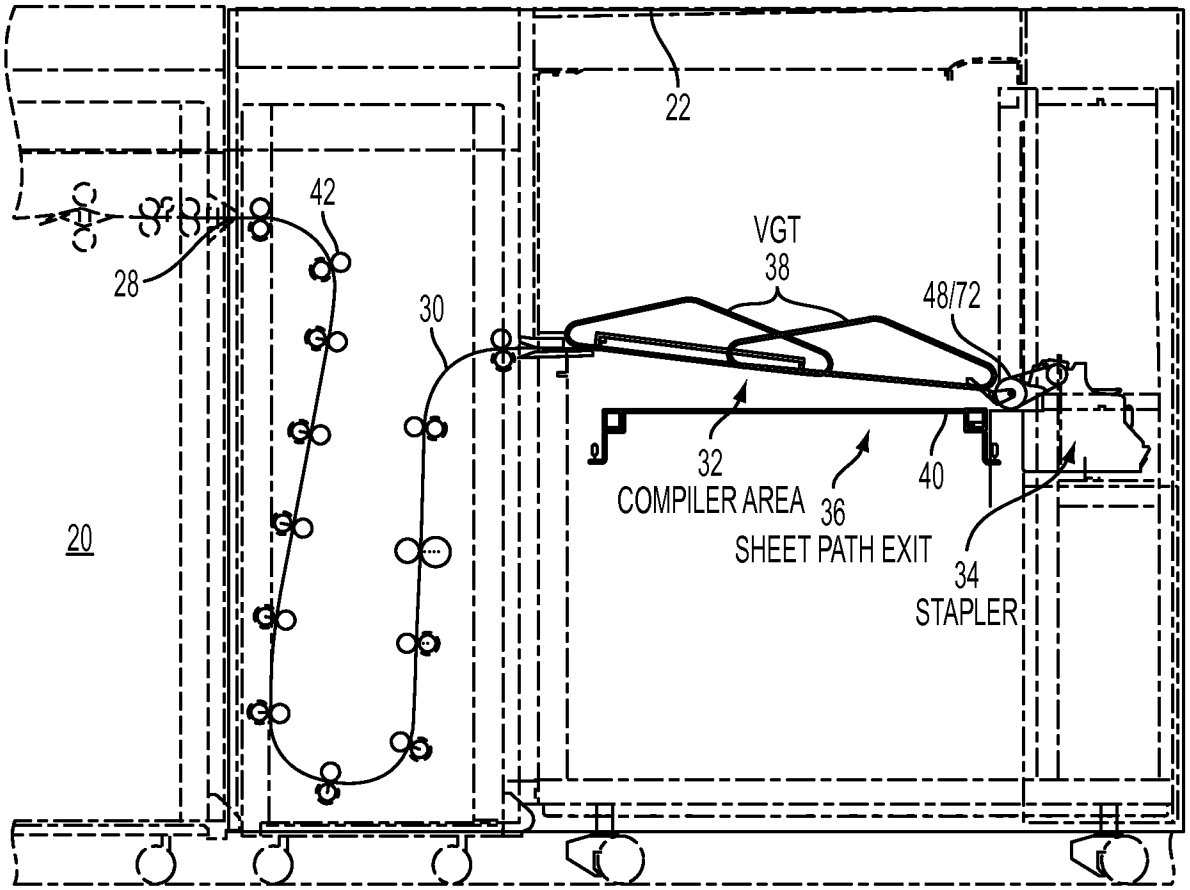
FIG. 1 is a schematic side elevational, sectional view of an exemplary production finisher having a sheet registration system with omnidirectional scuffer wheels constructed in accordance with the invention.
Figure 2:
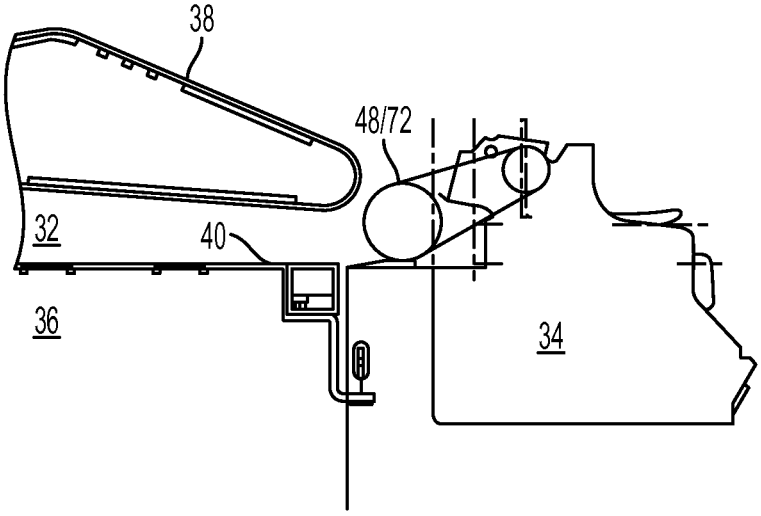
FIG. 2 is a schematic side elevational, sectional enlarged view of the registration system of FIG. 1, showing the scuffer in the lowered position.
Figure 3:
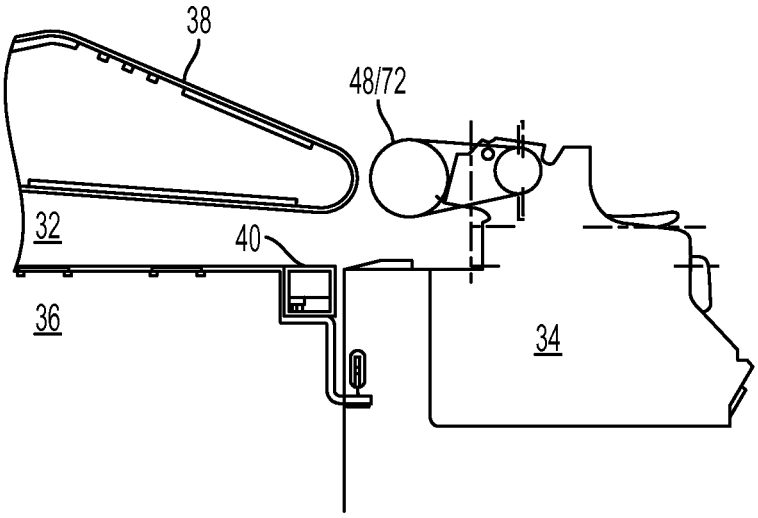
FIG. 3 is a schematic side elevational, sectional enlarged view of the registration system of FIG. 1, showing the scuffer in the raised position.

Referring to FIG. 1, a production finisher 22 is connected to a high speed printer 20 able to output at 157 prints per minute (PPM) production rate. The finisher 22 and printer 20 comprise a digital printing system. The system uses either a single media sheet 24, or a plurality of media sheets 24 arranged in sets 26. The finisher 22 typically has a media sheet path entrance 28, and a sheet path 30 along which the sheet 24 moves. A compiler sorts the sheets at a compiler area 32. A stapler 34 between the compiler area 32 and a sheet path exit 36 staples the sheets 24 in the set 26. The set 26 is then ejected at the sheet path exit 36. The embodiment described herein also has a vacuum gripper transport 38 or VGT adjacent the compiler, and a compiler shelf 40 to receive finished sets 14 of media sheets. The VGT can be any conventional vacuum gripper transport. Other transport means can be employed, as well. The compiler area 32 also includes a fine registration system described below to be implemented just prior to the stapling process. A plurality of transport nips 42 is arrayed along the sheet path 30.

Turning now to FIGS. 2-17, a sheet registration system 44 has omnidirectional scuffer wheels, and is for use in connection with the finisher 22 for the digital printing system. A media sheet 24, or a plurality of media sheets 24 arranged in sets 26, moves in a process direction 46 through the printing system.

The registration system includes a first scuffer 48 having a first omnidirectional wheel 50 and a second omnidirectional wheel 52, as shown in FIGS. 6-9. Each one of the first 50 and second 52 wheels has a wheel axis of rotation. The first 50 and second 52 wheels are mounted collinearly (on the same center axis) for corotation (rotation together at the same rate) on the wheel axis generally perpendicular to the process direction 46.

Each one of the first 50 and second 52 wheels has a hub 54 centered on the wheel axis. Each wheel 50, 52 has a plurality of spokes 56, each spoke 56 extending radially outward from a proximal end 58 at the hub 54 to a distal end 60. Each spoke distal end 60 has a pair of opposed trunnions 62A lying in a plane perpendicular to the wheel axis. Adjacent spokes 56 have facing trunnions 62B directed toward each other in a pair on a common trunnion axis. A trunnion 62 is a short bearing journal supporting either end of a rotating member.

Figure 10:
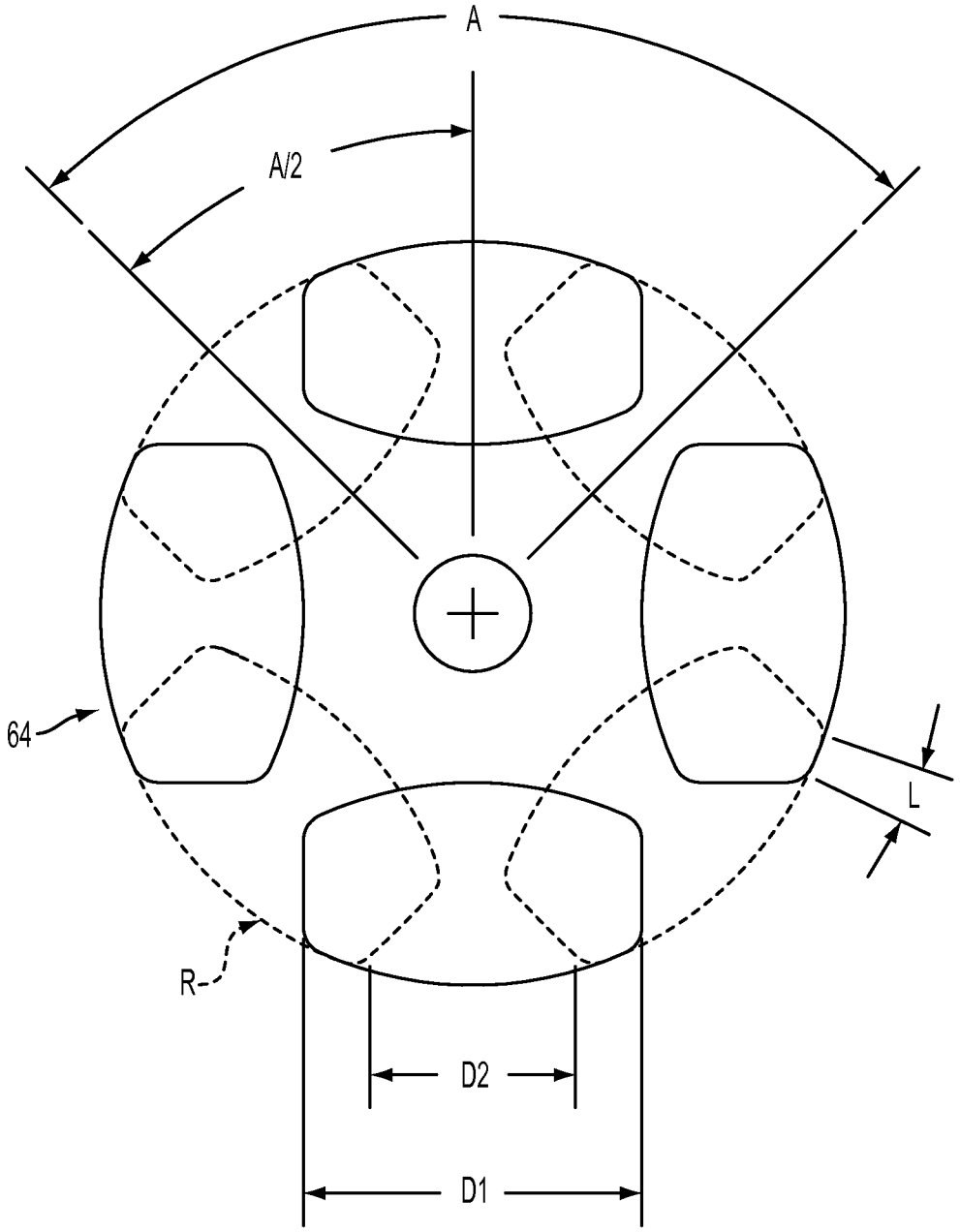
FIG. 10 is a schematic side elevational view of the scuffer wheel of FIG. 6, showing spatial relationships.
Figure 14:
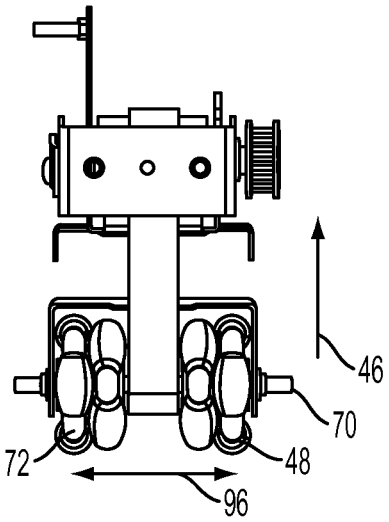
FIG. 14 is a top plan view of the scuffer assembly of FIG. 11.
Figure 11:
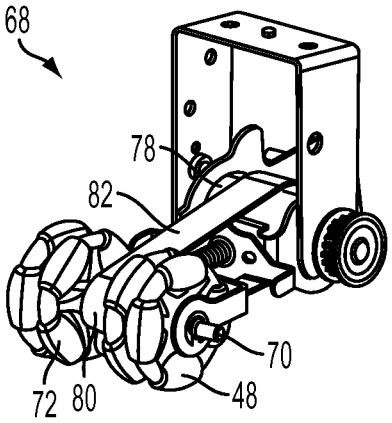
FIG. 11 is an isometric view of a scuffer assembly used in the registration system of FIG. 1.
Figure 12:
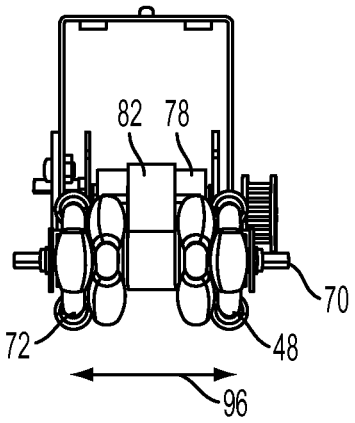
FIG. 12 is a front elevational view of the scuffer assembly of FIG. 11.
Figure 13:
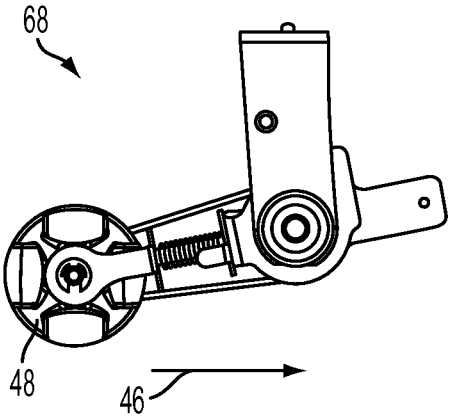
FIG. 13 is a side elevational view of the scuffer assembly of FIG. 11.
Figure 15:
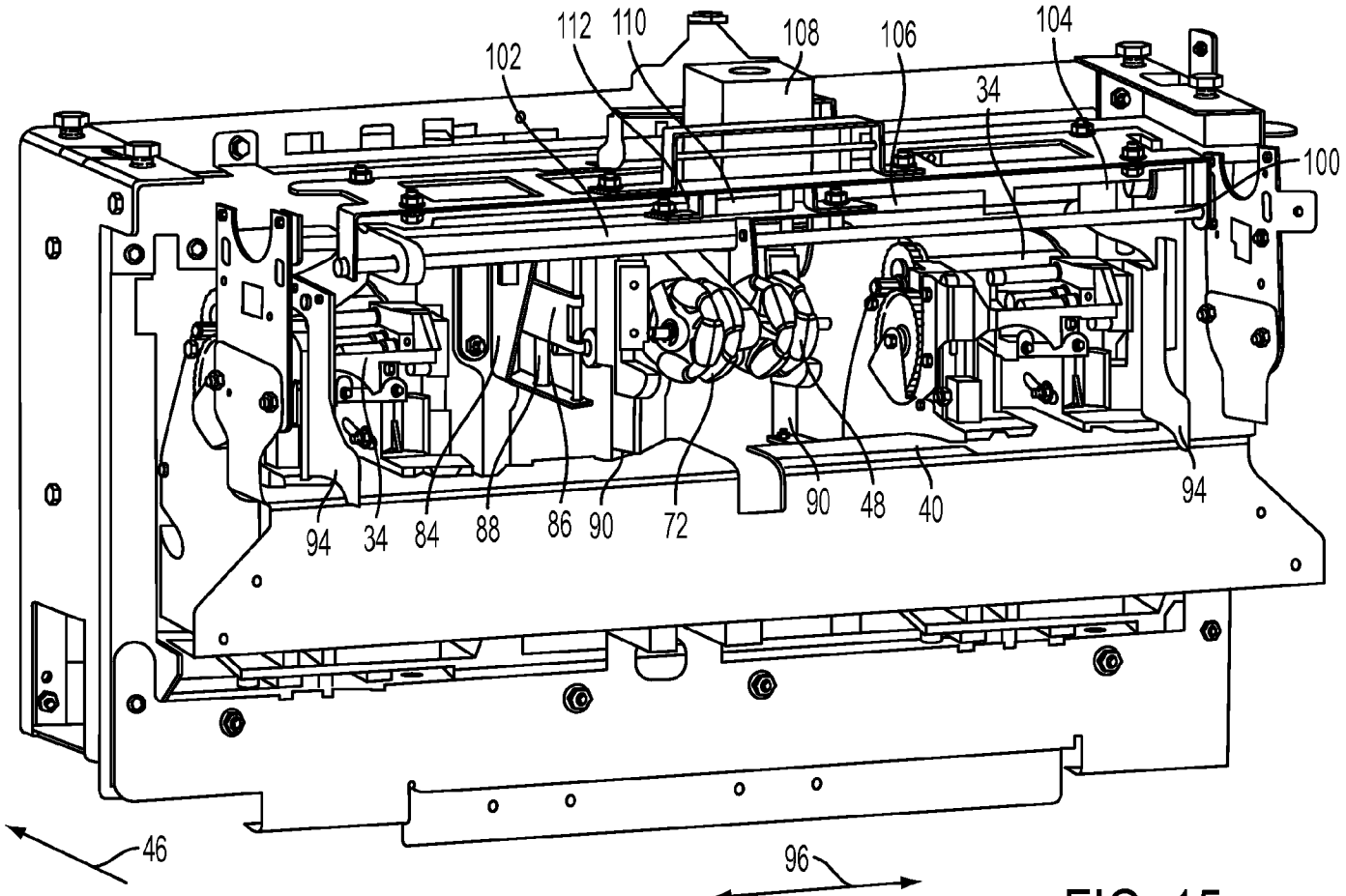
FIG. 15 is a front perspective sectional view of the production finisher of FIG. 1, showing the registration system scuffer in the raised position and the side tampers in the outer position.
Figure 16:
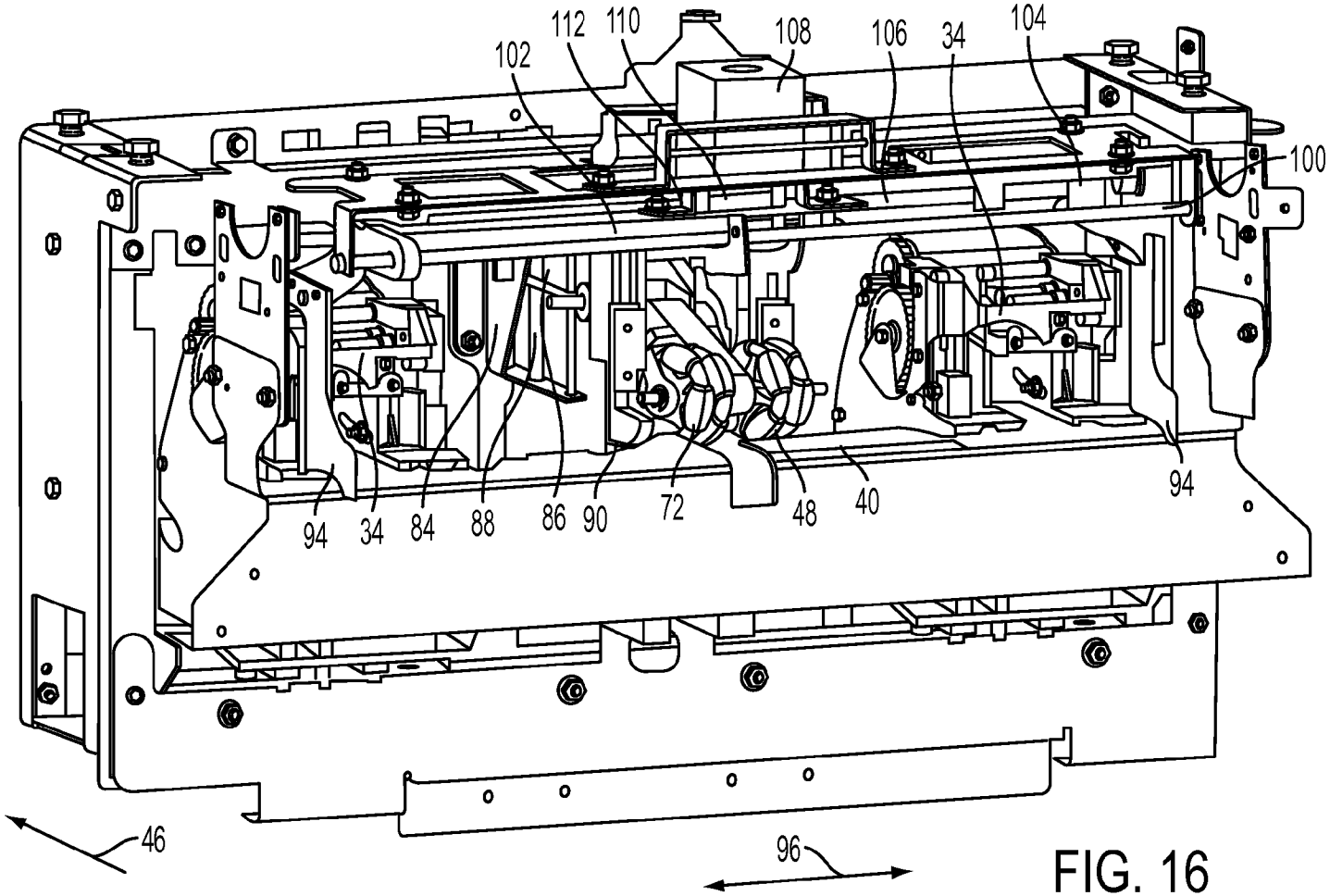
FIG. 16 is a front perspective sectional view of the production finisher of FIG. 1, showing the registration system scuffer in the lowered position and the side tampers in the outer position.
Figure 17:
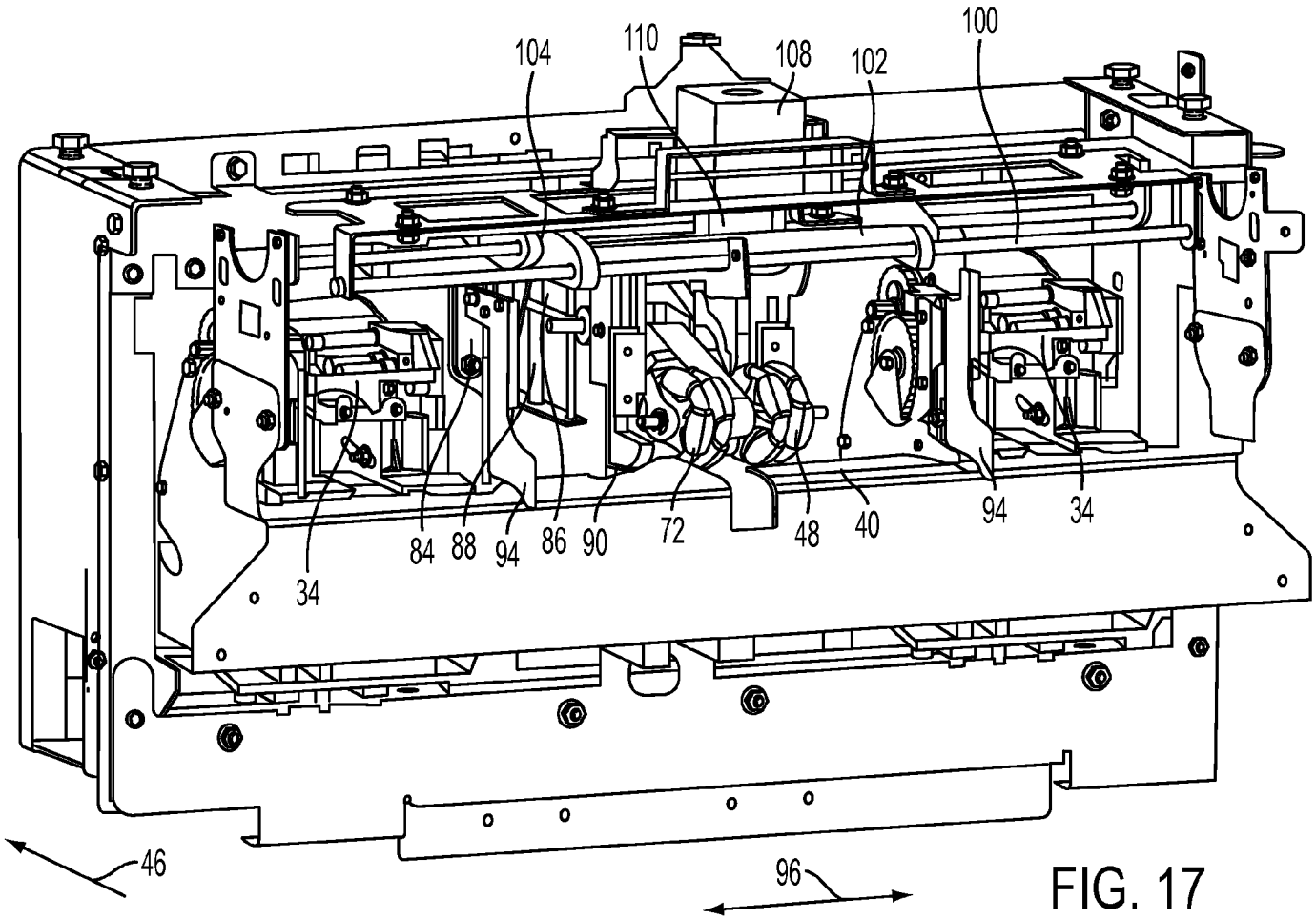
FIG. 17 is a front perspective sectional view of the production finisher of FIG. 1, showing the registration system scuffer in the lowered position and the side tampers in the inner position.

Each one of the first 50 and second 52 wheels has a plurality of rollers 64. Each roller 64 has a roller axis and a roller length D1 extending along the roller axis between opposite roller ends 66. Each roller 64 has a diameter on the roller axis being greatest intermediate the roller ends. The diameter decreases toward each of the roller ends in an arcuate curve of a predetermined radius R between the roller ends. Each roller 64 is mounted for rotation on a pair of the facing trunnions 62B. Adjacent rollers 64 on each wheel 50, 52 are spaced apart linearly end-to-end by a distance D2 less than the roller length D1, as shown in FIG. 10. Adjacent rollers 64 on each wheel 50, 52 are spaced apart angularly center-to-center by a predetermined angular displacement A. The first wheel 50 has an angular phase relationship A/2 with the second wheel 52 of one half the roller predetermined angular displacement A. Each roller 64 on the first wheel 50 partly overlaps angularly L each adjacent roller 64 on the second wheel 52.

A scuffer carriage 68 is mounted on the finisher 22 over the media sheet 24. The carriage 68 has an axle 70 mounted on an axle axis generally perpendicular to the process direction 46. The first scuffer 48 is mounted on the axle 70 for rotation. The carriage 68 is adapted for raising the scuffer 48 upward into a raised position out of contact with the media sheet 24. The carriage 68 is likewise adapted for lowering the scuffer 48 downward into a lowered position into contact with the media sheet 24.

The registration system optionally also includes a second scuffer 72, which is identical to the first scuffer 48. The second scuffer 72 has a third omnidirectional wheel 74 and a fourth omnidirectional wheel 76. Each one of the third 74 and fourth 76 wheels has a wheel axis of rotation. The third 74 and fourth 76 wheels are mounted collinearly for corotation on the wheel axis generally perpendicular to the process direction 46.

Each one of the third 74 and fourth 76 wheels has a hub 54 centered on the wheel axis, and a plurality of spokes 56. Each spoke 56 extends radially outward from a proximal end 58 at the hub 56 to a distal end 60. Each spoke distal end 60 has a pair of opposed trunnions 62A lying in a plane perpendicular to the wheel axis. Adjacent spokes 56 have facing trunnions 62B directed toward each other in a pair on a common trunnion axis.

Each one of the third 74 and fourth 76 wheels has a plurality of rollers 64. Each roller 64 has a roller axis and a roller length D1 extending along the roller axis between opposite roller ends 66. Each roller 64 has a diameter on the roller axis being greatest intermediate the roller ends 66. The diameter decreases toward each of the roller ends 66 in an arcuate curve of a predetermined radius R between the roller ends 66. Each roller 64 is mounted for rotation on a pair of the facing trunnions 62. Adjacent rollers 64 on each wheel 74, 76 are spaced apart linearly end-to-end by a distance D2 less than the roller length D1. Adjacent rollers 64 on each wheel 74, 76 are spaced apart angularly center-to-center by a predetermined angular displacement A. The third wheel 76 has an angular phase relationship A/2 with the fourth wheel 76 of one half the roller predetermined angular displacement A. Each roller 64 on the third wheel 76 partly overlaps angularly L each adjacent roller 64 on the fourth wheel 76. The second scuffer 72 is mounted on the axle 70 with the first scuffer 48 for rotation in unison with the first scuffer 48.

Thus, with the scuffer carriage 68 in the lowered position, and with the scuffer 48/72 rotating, the overlapping scuffer rollers 64 will provide uninterrupted traction against the media sheet 24 in the process direction 46. Conversely, the scuffer rollers 64 will allow free movement in the cross-process direction while touching the media sheet 24.

Driving means is provided for rotationally driving the scuffer. In one embodiment shown, a drive pulley 78 is adapted for receiving power from a power source (not shown), typically an electric motor. A driven pulley 80 is mounted collinearly with the axle 70 and operatively connected to the scuffer 48/72. A belt 82 connects the drive pulley 78 and the driven pulley 80. It is to be understood that many alternative driving means are well known to those skilled in the art, and are to be considered equivalent embodiments to that shown, within the spirit and scope of the claims.

A scuffer actuator 84 is provided for selectively lowering and raising the scuffer 48/72. In the embodiment shown and claimed, a block 86 is provided with internal threads (not shown). The block 86 is operatively connected to the scuffer carriage 68. A generally vertical shaft 88 with external threads operatively engages the block internal threads. A scuffer drive motor (not shown), typically an electric motor, is operatively connected to the shaft. Thus, the scuffer drive motor will rotate the shaft 88, and the threads will move the block 86 upward and downward, thereby selectively lowering and raising the scuffer 48/72. It is to be understood that many alternative scuffer actuator configurations are well known to those skilled in the art, and are to be considered equivalent embodiments to that shown, within the spirit and scope of the claims.

A registration wall 90 is disposed generally vertically and facing generally upstream to the process direction 46. The registration wall 90 is designed to align a leading edge of the media sheet 24. Thus, in the lowered position with the scuffer 48/72 rotating, the scuffer 48/72 will move the media sheet 24 in the upstream direction 92, which is also the process direction 46. The scuffer 48/72 will thereby move the media sheet 24 against the registration wall 90 for process direction registration.

A pair of opposed tamper plates 94 is disposed generally vertically and facing generally perpendicularly to the cross process direction 96. The tamper plates 94 are spaced apart on either side of the media sheet 24. The tamper plates 94 are mounted for translation toward one another. Hence, during registration, with the scuffer 48/72 in the lowered position and with the scuffer rotating, the tamper plates 94 will move toward one another (arrows 98), pushing the media sheet 24 in the cross process direction 96, or in the case of sets, pushing a plurality of media sheets 24 together in the cross process direction 96. The freely rotating scuffer rollers 64 will allow free movement of the media sheets 24 in the cross process direction 96. In this manner, cross process registration occurs simultaneously with process direction registration.

Figure 4:
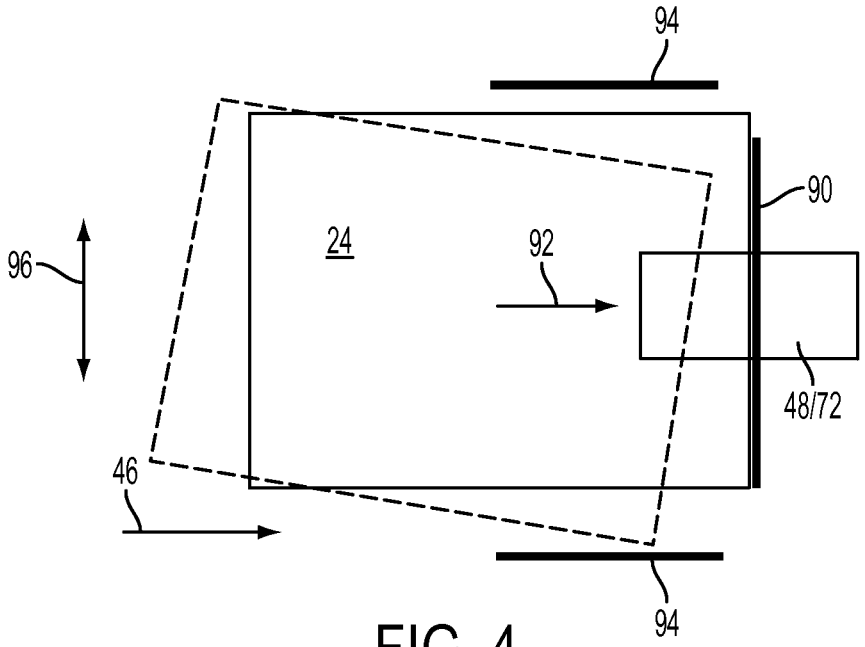
FIG. 4 is a schematic plan view of the registration system of FIG. 1, showing process direction registration by the scuffer.
Figure 5:
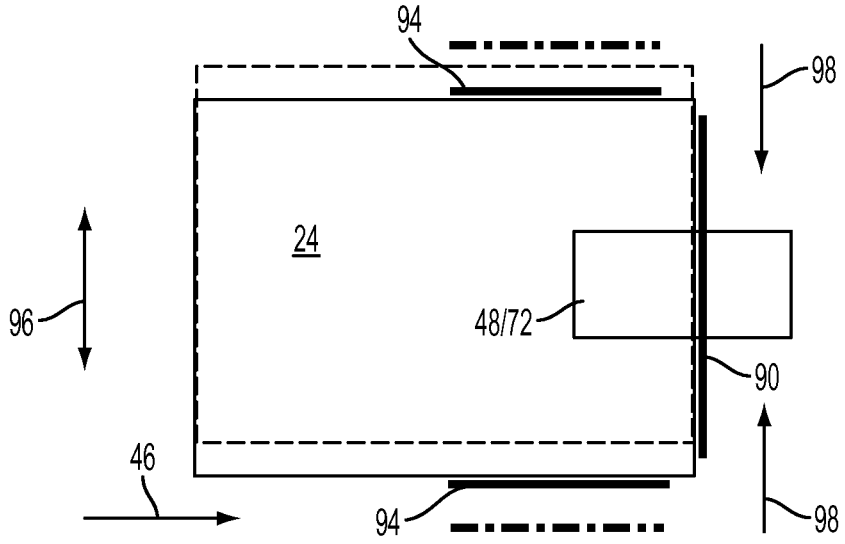
FIG. 5 is a schematic plan view of the registration system of FIG. 1, showing cross-process direction registration by the side tampers.
Figure 6:
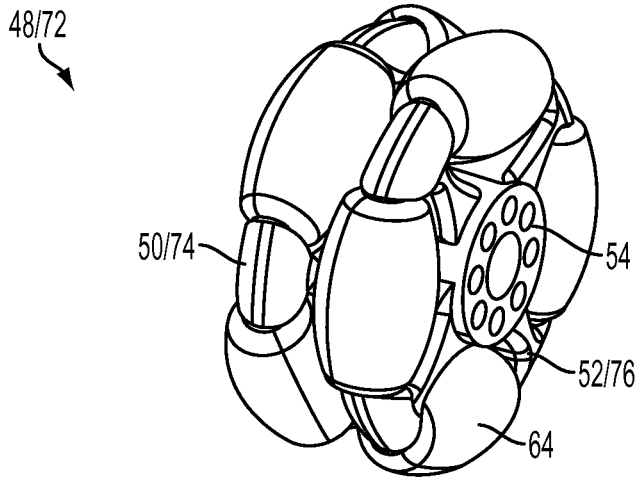
FIG. 6 is an isometric view of a scuffer wheel used in the registration system of FIG. 1.
Figure 7:
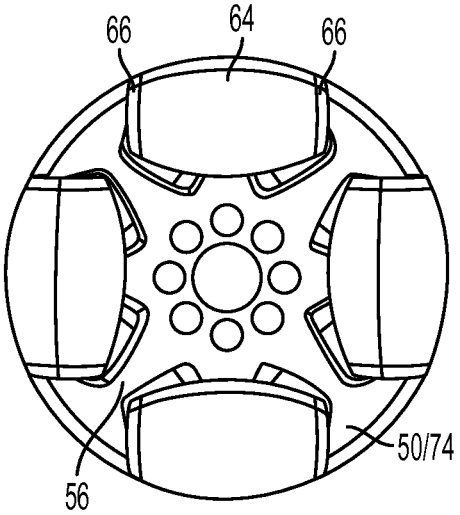
FIG. 7 is a side elevational view of the scuffer wheel of FIG. 6.
Figure 8:
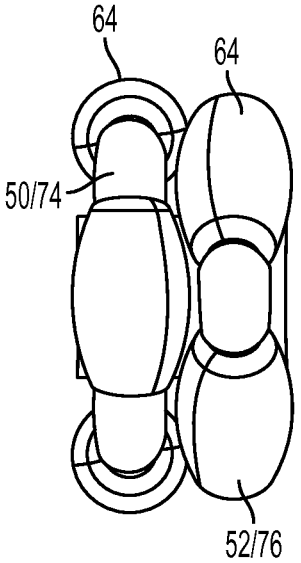
FIG. 8 is a front elevational view of the scuffer wheel of FIG. 6.
Figure 9:
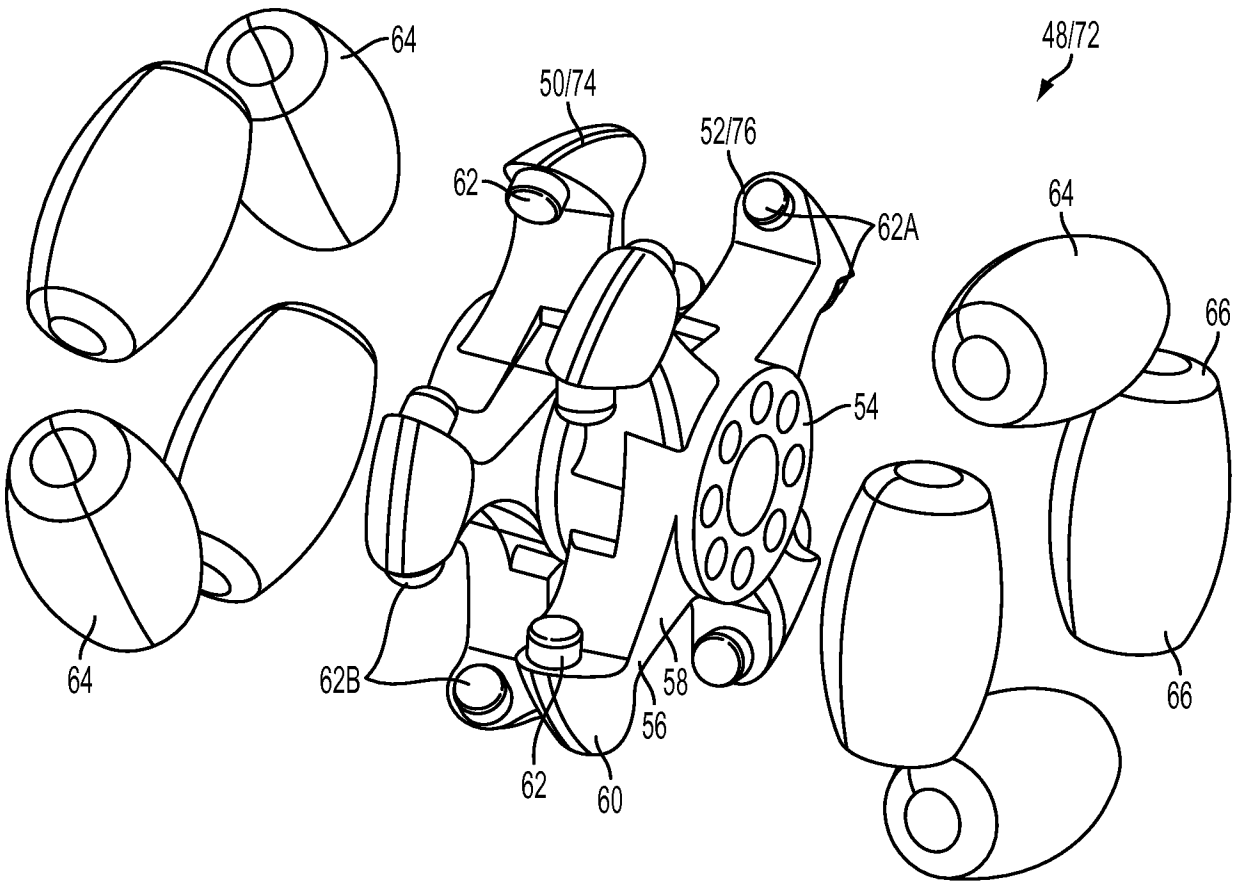
FIG. 9 is an exploded isometric view of the scuffer wheel of FIG. 6.

FIG. 4 shows process direction registration being carried out. The scuffer 48/72 is moving the media sheet 24 in the upstream direction 92 and against the registration wall 90. Simultaneously, in FIG. 5, cross process registration is being carried out. The tamper plates 94 are moving toward one another, pushing the media sheet 24 in the cross process direction 96. Process direction registration is maintained by not lifting the scuffer from the media sheet 24 during cross process registration, and registration time is minimized. Therefore, the high production rate of 157 ppm is maintained.

A tamper actuator 98 is provided for selectively moving the tamper plates 94 toward one another and away from one another. In this embodiment, a linear guide bar 100 is disposed transversely to the process direction. A tamper carriage 102 is mounted for linear motion on the linear guide bar 100. A one of the tamper plates 94 is attached to the tamper carriage 102. Similarly, a second tamper carriage 104 is mounted for linear motion on a second linear guide bar 106. The opposite one of the tamper plates 94 is attached to the second tamper carriage 104. A tamper drive motor 108, including a sheave 110 and cables 112, is operatively connected to the tamper carriages 102, 104. The tamper drive motor 108 will move the tamper carriage 102 transversely, thereby selectively moving the one of the tamper plates 94 toward the opposed tamper plate 94, and away from the opposed tamper plate 94. The tamper drive motor 108 will move the tamper carriage 104 transversely in a similar manner. It is to be understood that many alternative tamper actuator configurations are well known to those skilled in the art, and are to be considered equivalent embodiments to that shown, within the spirit and scope of the claims.

After registration is accomplished, the scuffer 48/72 is raised upward into a raised position, thereby retracting the rollers 64 from contact with the media sheet 24. The tamper plates 94 are moved away from one another, thereby releasing the media sheet 24. The media sheet 24 or the set 26 of media sheets 24 is then finished and ejected.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A sheet registration system with omnidirectional scuffer wheels for use in connection with a finisher for a digital printing system and at least one media sheet moving in a process direction, the registration system comprising:

a first scuffer having a first omnidirectional wheel and a second omnidirectional wheel, each one of the first and second wheel having a wheel axis of rotation, the first and second wheels being mounted collinearly for corotation on the wheel axis generally perpendicular to the process direction, each one of the first and second wheel having a plurality of spokes, adjacent spokes having facing trunnions directed toward each other in a pair on a common trunnion axis, each one of the first and second wheel having a plurality of rollers, each roller having a roller length extending between opposite roller ends, each roller having an arcuate curve of a predetermined radius between the roller ends, each roller being mounted for rotation on a pair of the facing trunnions, adjacent rollers on each wheel being spaced apart linearly end-to-end by a distance less than the roller length, each roller on the first wheel partly overlapping each adjacent roller on the second wheel;

a scuffer carriage mounted on the finisher over the media sheet, the carriage having an axle mounted generally perpendicular to the process direction, the first scuffer being mounted on the axle for rotation, the carriage being adapted for raising the scuffer upward into a raised position out of contact with the media sheet and for lowering the scuffer downward into a lowered position into contact with the media sheet;

driving means for rotationally driving the scuffer, a registration wall disposed generally vertically and facing generally upstream to the process direction, so as to align a leading edge of the media sheet, so that in the lowered position with the scuffer rotating, the overlapping scuffer rollers will provide uninterrupted traction against the media sheet in the process direction, and the scuffer will move the media sheet against the registration wall for process direction registration; and a pair of opposed tamper plates disposed generally vertically and facing one another in the cross process direction on either side of the media sheet, the tamper plates being mounted for translation toward one another, so that during registration the tamper plates will move toward one another pushing the media sheet in the cross process direction, and the freely rotating scuffer rollers will allow free movement of the media sheet in the cross process direction, for cross process registration simultaneously with process direction registration.

2. The sheet registration system of claim 1, further comprising a second scuffer having a third omnidirectional wheel and a fourth omnidirectional wheel, each one of the third and fourth wheel having a wheel axis of rotation, the third and fourth wheels being mounted collinearly for corotation on the wheel axis generally perpendicular to the process direction, each one of the third and fourth wheel having a plurality of spokes, adjacent spokes having facing trunnions directed toward each other in a pair on a common trunnion axis, each one of the third and fourth wheel having a plurality of rollers, each roller having a roller length extending between opposite roller ends, each roller having an arcuate curve of a predetermined radius between the roller ends, each roller being mounted for rotation on a pair of the facing trunnions, adjacent rollers on each wheel being spaced apart linearly end-to-end by a distance less than the roller length, each roller on the third wheel partly overlapping each adjacent roller on the fourth wheel, the second scuffer being mounted on the axle with the first scuffer for rotation in unison with the first scuffer.

3. The sheet registration system of claim 1, wherein the driving means further comprises:

a drive pulley adapted for receiving power from a power source;

a driven pulley mounted collinearly with the axle and operatively connected to the scuffer; and a belt connecting the drive pulley and the driven pulley.

4. The sheet registration system of claim 1 further comprising a scuffer actuator including:

a block with internal threads, the block operatively connected to the scuffer carriage;

a generally vertical shaft with external threads operatively engaging the block internal threads; and a scuffer drive motor operatively connected to the shaft, so that the motor will rotate the shaft, and the threads will move the block upward and downward, thereby selectively lowering and raising the scuffer.

5. The sheet registration system of claim 1 further comprising a tamper actuator including:

a linear guide bar disposed transversely to the process direction;

a tamper carriage mounted for linear motion on the linear guide bar, a one of the tamper plates being attached to the tamper carriage; and a tamper drive motor operatively connected to the tamper carriage, so that the drive motor will move the tamper carriage transversely, thereby selectively moving the tamper plate toward the opposed plate, and away from the opposed plate.

6. A sheet registration system with omnidirectional scuffer wheels for use in connection with a finisher for a digital printing system and at least one media sheet moving in a process direction, the registration system comprising:

a first scuffer having a first omnidirectional wheel and a second omnidirectional wheel, each one of the first and second wheel having a wheel axis of rotation, the first and second wheels being mounted collinearly for corotation on the wheel axis generally perpendicular to the process direction, each one of the first and second wheel having a hub centered on the wheel axis, and a plurality of spokes, each spoke extending radially outward from a proximal end at the hub to a distal end, each spoke distal end having a pair of opposed trunnions lying in a plane perpendicular to the wheel axis, adjacent spokes having facing trunnions directed toward each other in a pair on a common trunnion axis, each one of the first and second wheel having a plurality of rollers, each roller having a roller axis and a roller length extending along the roller axis between opposite roller ends, each roller having a diameter on the roller axis being greatest intermediate the roller ends, the diameter decreasing toward each of the roller ends in an arcuate curve of a predetermined radius between the roller ends, each roller being mounted for rotation on a pair of the facing trunnions, adjacent rollers on each wheel being spaced apart linearly end-to-end by a distance less than the roller length, adjacent rollers on each wheel being spaced apart angularly center-to-center by a predetermined angular displacement, the first wheel having an angular phase relationship with the second wheel of one half the roller predetermined angular displacement, each roller on the first wheel partly overlapping angularly each adjacent roller on the second wheel;

a scuffer carriage mounted on the finisher over the media sheet, the scuffer carriage having an axle mounted on an axle axis generally perpendicular to the process direction, the first scuffer being mounted on the axle for rotation, the scuffer carriage being adapted for raising the scuffer upward into a raised position out of contact with the media sheet and for lowering the scuffer downward into a lowered position into contact with the media sheet;

driving means for rotationally driving the scuffer, so that in the lowered position with the scuffer rotating, the overlapping scuffer rollers will provide uninterrupted traction against the media sheet in the process direction;

a scuffer actuator for selectively lowering and raising the scufler;

a registration wall disposed generally vertically and facing generally upstream to the process direction, so as to align a leading edge of the media sheet, so that in the lowered position with the scuffer rotating, the scoffer will move the media sheet against the registration wall for process direction registration;

a pair of opposed tamper plates disposed generally vertically and facing generally perpendicularly to the cross process direction, the tamper plates being spaced apart on either side of the media sheet, the tamper plates being mounted for translation toward one another, so that during registration, with the scuffer in the lowered position and with the scuffer rotating, the tamper plates will move toward one another pushing the media sheet in the cross process direction, and the freely rotating scuffer rollers will allow free movement of the media sheet in the cross process direction, for cross process registration simultaneously with process direction registration; and a tamper actuator for selectively moving the tamper plates toward one another and away from one another.

7. The sheet registration system of claim 6, further comprising a second scuffer having a third omnidirectional wheel and a fourth omnidirectional wheel, each one of the third and fourth wheel having a wheel axis of rotation, the third and fourth wheels being mounted collinearly for corotation on the wheel axis generally perpendicular to the process direction, each one of the third and fourth wheel having a hub centered on the wheel axis, and a plurality of spokes, each spoke extending radially outward from a proximal end at the hub to a distal end, each spoke distal end having a pair of opposed trunnions lying in a plane perpendicular to the wheel axis, adjacent spokes having facing trunnions directed toward each other in a pair on a common trunnion axis, each one of the third and fourth wheel having a plurality of rollers, each roller having a roller axis and a roller length extending along the roller axis between opposite roller ends, each roller having a diameter on the roller axis being greatest intermediate the roller ends, the diameter decreasing toward each of the roller ends in an arcuate curve of a predetermined radius between the roller ends, each roller being mounted for rotation on a pair of the facing trunnions, adjacent rollers on each wheel being spaced apart linearly end-to-end by a distance less than the roller length, adjacent rollers on each wheel being spaced apart angularly center-to-center by a predetermined angular displacement, the third wheel having an angular phase relationship with the fourth wheel of one half the roller predetermined angular displacement, each roller on the third wheel partly overlapping angularly each adjacent roller on the fourth wheel, the second scuffer being mounted on the axle with the first scuffer for rotation in unison with the first scuffer.

8. The sheet registration system of claim 6, wherein the driving means further comprises:

a drive pulley adapted for receiving power from a power source;

a driven pulley mounted collinearly with the axle and operatively connected to the scuffer; and a belt connecting the drive pulley and the driven pulley.

9. The sheet registration system of claim 6, wherein the scuffer actuator further comprises:

a block with internal threads, the block operatively connected to the scuffer carriage;

a generally vertical shaft with external threads operatively engaging the block internal threads; and a scuffer drive motor operatively connected to the shaft, so that the scuffer drive motor will rotate the shaft, and the threads will move the block upward and downward, thereby selectively lowering and raising the scuffer.

10. The sheet registration system of claim 6, wherein the tamper actuator further comprises:

a linear guide bar disposed transversely to the process direction;

a tamper carriage mounted for linear motion on the linear guide bar, a one of the tamper plates being attached to the tamper carriage; and a tamper drive motor operatively connected to the tamper carriage, so that the tamper drive motor will move the tamper carriage transversely, thereby selectively moving the one of the tamper plates toward the opposed tamper plate, and away from the opposed tamper plate.

* * * * *